United States Patent [19]

Pintsov et al.

[11] Patent Number: 4,829,443

[45] Date of Patent: May 9, 1989

[54] INSERTION MACHINE WITH COMPUTERIZED POSTAGE SEARCH AND PRIORITIZED SELECTION OF INSERTS

[75] Inventors: Leon A Pintsov, West Hartford; Robert A. Tracy, Danbury, both of Conn.

[73] Assignee: Pitney Bowes Inc., Stamford, Conn.

[21] Appl. No.: 10,260

[22] Filed: Feb. 2, 1987

[51] Int. Cl.[4] ..... G07B 17/02; B65B 35/50

[52] U.S. Cl. ..... 364/464.03; 53/154; 364/478

[58] Field of Search ..... 364/200, 464, 466, 900, 364/478, 464.02, 464.03; 53/154

[56] References Cited

U.S. PATENT DOCUMENTS

| | | | |
|---|---|---|---|
| 3,226,683 | 12/1965 | Gaffney, Jr. | 364/200 |
| 3,935,429 | 1/1976 | Branecky et al. | 209/900 X |
| 4,077,181 | 3/1978 | Asher et al. | 53/154 X |
| 4,138,735 | 2/1979 | Allocca et al. | 364/900 |
| 4,139,892 | 2/1979 | Gudea et al. | 364/571 X |
| 4,395,756 | 7/1983 | Daniels | 364/200 |
| 4,410,962 | 10/1983 | Daniels et al. | 364/900 |
| 4,571,925 | 2/1986 | Adams | 53/54 X |
| 4,639,873 | 1/1987 | Baggarly et al. | 364/466 |
| 4,734,865 | 3/1988 | Scullion et al. | 364/478 |
| 4,797,830 | 1/1989 | Baggarly et al. | 53/154 X |

*Primary Examiner*—Parshotam S. Lall
*Assistant Examiner*—Edward R. Cosimano
*Attorney, Agent, or Firm*—Lawrence E. Sklar; David E. Pitchenik; Melvin J. Scholnick

[57] ABSTRACT

An insertion machine system provides for the rapid determination of a value of postage required for a mailpiece by a table search technique which searches for and locates the value of postage in a predetermined table of postage values, the search being guided by the information provided by a predetermined data key.

27 Claims, 3 Drawing Sheets

| | 1 | 2 | 3 | 4 | 5 | 6 | 7 |
|---|---|---|---|---|---|---|---|
| CA | # 1-1<br># 2-0<br># 3-1<br>12.25 | # 1-1<br># 2-0<br># 3-2<br>13.50 | # 1-1<br># 2-0<br># 3-3<br>14.75 | # 1-1<br># 2-0<br># 3-4<br>16.00 | # 1-1<br># 2-0<br># 3-5<br>17.25 | # 1-1<br># 2-0<br># 3-6<br>18.50 | # 1-1<br># 2-0<br># 3-7<br>19.75 |
| CB | # 1-0<br># 2-2<br># 3-1<br>10.50 | # 1-0<br># 2-2<br># 3-2<br>11.75 | # 1-0<br># 2-2<br># 3-3<br>13.00 | . . . | . . | . . . | . . |
| CC | # 1-1<br># 2-1<br># 3-1<br>11.50 | # 1-1<br># 2-1<br># 3-2<br>12.75 | . . | . . | . . | . . | . . |
| CD | | | | ⋮ | | | |

INSERTION MACHINE WITH COMPUTERIZED POSTAGE SEARCH AND PRIORITIZED SELECTION OF INSERTS

BACKGROUND OF THE INVENTION

1. Field of the Invention

The present invention relates generally to insertion machines and, more particularly, pertains to an insertion machine operable for searching a data table in order to determine an amount of postage for a mailpiece and/or to determine a prioritized selection of documents to be included in the mailpiece.

2. Description of the Prior Art

Multifeeder station machines are widely utilized for mailing applications wherein a plurality of different types of enclosures, such as account related enclosures, advertising enclosures or enclosures of general or limited interest, are to be included with a customer's monthly statement. Examples of such applications are monthly statements mailed by utilities, credit card companies, and banking or other financial institutions. Included, typically, with the statement are one or more enclosures, or inserts, which may convey a message to the company's customers, such as an offer of additional services, or of a change in company policy, or advertisements provided by third parties for inclusion within the company's monthly mailing.

Illustrative of such insertion machines are a U.S. Pat. No. 3,935,429, issued Jan. 27, 1976 to George N. Branecky and Gary R. Sochrim, and a U.S. Pat. No. 4,077,181, issued Mar. 7, 1978 to Leslie K. Asher, Charles E. Gibson, and Frank T. Roetter, each of the aforementioned patents being assigned to the assignee of the present application. Also illustrative of such an insertion machine is U.S. Pat. No. 4,733,359 issued Mar. 22, 1988 entitled: Document Collating and Inserting System Having Displays for Document Count Verification, in the names of Harry Luperti and Robert Irvine.

Although the current insertion machines are well suited for their intended applications, the evolving requirements of the marketplace now demand insertion machines capable of making last miinute decisions regarding: (a) which documents, or inserts, are to be included in a mailpiece and (b) a required amount of postage for the mailpiece.

An application where this capability may prove especially advantageous concerns bank checking accounts wherein a variable number of documents expressive of a customer's monthly statement, a variable number of cancelled checks, and possibly one or more inserts of a general or advertising nature are required to be mailed. Due at least to the variation of the number of statement pages and cancelled checks between customers, the required postage for mailpieces produced will consequently vary over a wide range of postage values.

As is well known, the present postage rate categories for first-class letter mail are ultimately based on a final, total weight of a mailpiece. Therefore, any procedure for determining the correct amount of postage for a mailpiece must involve at some point in the procedure a weight-determining step.

Traditionally, such a weight-determining step would comprise weighing the stuffed envelope. As insertion machine throughputs increase, however, this technique of weighing each mailpiece becomes less practical, more complex and, hence, more expensive for the customer. Furthermore, such a weighing does not lend itself to supporting other advancements in insertion machine technology, such as a dynamic selection of inserts based on priority levels and/or the extremely desirable goal of "topping off" a mailpiece with additional inserts to take full advantage of a monetary value of a postage category.

In response to this limitation of the prior art it has been known to provide an insertion machine wherein the per item weight of the inserts held at a plurality of feeding stations is stored in a data processing memory. A processing means, using the stored per item weights, calculates a total weight based on the number of inserts selectively fed from the feeding stations. This calculated weight is then utilized to determine which one of a plurality of postage meters, each being set to apply postage relating to a different weight category, will be subsequently activated to apply postage to the envelope. Such a machine is disclosed in U.S. Pat. No. 4,571,925 issued on Feb. 25, 1986 to Jerryl Adams.

A problem arises in the use of such a system in that the processing means, which is an embedded microprocessor-based processing unit, is required to calculate the total weight of each mailpiece in a realtime manner while simultaneously controlling the activation of various feeding stations, postage meters, and other machine components. This problem is made especially acute as the number of feeding stations is increased. Inasmuch as modern insertion machines rely on a "pipelined" stream of documents being processed at any given time in order to achieve a high mailpiece throughput, there may be a large number of mailpieces being processed at any given time by the machine. The demands placed upon the processing unit in controlling the oepration of the machine and simultaneously calculating the total weights of a plurality of mailpieces may place a limitation on the number of feed stations which the machine may have. In addition, such processing unit demands may result in the throughput of the machine being limited to an economically unjustifiable low rate.

Another problem in the use of such a machine is that the machine, unlike an insertion machine disclosed in a copending application Ser. No. 890,677, filed on July 30, 1986 (abandoned in favor of continuing application Ser. No. 205,584 filed June 6, 1988) for L. Pintsov and entitled "Insertion Machine With Prioritized Selection Of Inserts", does not address the desirable goal of optimizing the number of the included inserts in order to achieve the full benefit of the postage category into which the envelope falls. Neither does such a machine address the problem of the selection of enclosures for insertion based on criteria other than weight, such as demographic or other characteristics of the addressee.

It is therefore an objective of the present invention to provide an insertion machine system which rapidly determines a required value of postage for a mailpiece in a real-time, low cost, and high speed manner.

It is a further objective of the present invention to provide an insertion machine system wherein a predetermined data table of postage values is generated remotely from the insertion machine and thereafter inputted into the insertion machine at a time prior to the time that the machine is utilized for the insertion of documents.

It is a further objective of the present invention to provide an insertion machine system which determines a required value of postage for a mailpiece by utilizing a table search technique to look-up the required value in a predetermined data table of postage values.

It is a further objective of the present invention to provide an insertion machine system wherein a predetermined data key, or token, descriptive of the required documents for a specific mailpiece is inputted into the insertion machine to enable the machine to rapidly search a data table to locate a required value of postage for the specific mailpiece and/or to determine which inserts to include within a particular mailpiece.

It is a still further objective of the present invention to provide an insertion machine system wherein the predetermined data key is descriptive of which documents are to be fed for a particular mailpiece, the documents being selected according to an application specific prioritization scheme whereby the total number and type of documents selected results in realizing the full value of a required postage category and/or in selecting specific documents based on demographic or other characteristics of the addressee.

SUMMARY OF THE INVENTION

The aforementioned problems of the prior art are overcome and the foregoing objectives are achieved by an insertion machine system which, in accordance with the invention, provides for the rapid determination of a value of postage required for a mailpiece by a table search technique which searches for and locates the value of postage in a predetermined table of postage values.

In accordance with the instant invention, a required value of postage for a mailpiece is determined by (a) generating a table of data having a plurality of entries each of which is expressive of one of a plurality of postage values which mailpieces may be assigned relative to enclosure types which comprise the mailpieces; (b) identifying the enclosure type or types for a certain mailpiece for which the required value of postage is to be determined; and (c) searching the table to locate an entry corresponding to the enclosure type or types of the certain mailpiece whereby the required value of postage is determined.

In an illustrative embodiment, a multistation inserter system for inserting into an envelope items to be mailed, such as cancelled bank checks and an associated single or multipage statement along with possibly one or more inserts of an informational or advertising nature, is provided with an integral, or embedded, processing unit, such as a microprocessor, having the requisite memory and other support means to execute a software program. In order to accurately determine in a rapid and efficient manner the amount of postage to be applied to the envelope by a postage meter or meters associated with the inserter system, or by other means such as in a manifest type of system, the processing means is provided with a data table having a plurality of entries corresponding to the total possible combinations of numbers of items which may be fed from each of the feeder stations in order to form each possible mailpiece, i.e., the carrier envelope and required inserts. The table may have the well known form of a tree structure wherein each of the entries forms a node, each such node being a locus of branches to other nodes. Each node, or entry, of the table contains data expressive of a corresponding value of postage and, also, may contain data expressive of which inserts to feed for a particular mailpiece.

In accordance with the invention, the processing unit is provided with a data key, or token, for each mailpiece to be assembled, the key indicating, typically, which of the insert feeding stations are to be activated for the particular mailpiece and, in addition, how many inserts from each such activated station are to be fed. In accordance with the invention, the key may also be expressive of the relative priorities assigned to each of the insert types. One or more of the insert feeders may be of the one insert per machine cycle type which feed only one insert for each mailpiece. Other insert feeders may be high speed type feeders, such as check feeders or other types of multiple document entry devices, which are capable of feeding a plurality of documents for each machine cycle. The data key may be provided to the processing unit upon a master control document in a dash code or some other machine readable format. Based upon the key, the processing unit during the operation of the inserter system executes a software search routine through the table. The terminal, or leaf node determined by the search, based upon a particular data key, will contain data expressive of postage, such as a monetary value of postage to be applied to a mailpiece with the key.

The table is created, typically, prior to a run of the inserter system by entering data into a table generation program, which program may reside in either a standalone data processing unit, such as a personal computer, or in the processing unit of the inserter system itself. In operation, the weight of each document type (including the required carrier envelope) which may be included within a mailpiece during an impending run of the inserter system is determined and entered into the applicable data processing unit. Such a determined weight is considered to be an "intrinsic" weight of that document type. Each intrinsic weight so determined is converted to an intrinsic postage amount, either by the data processing unit operator or by the table generation program within the data processing unit.

If the weight/postage value conversion is made by the table generation program, the data processing unit operator enters into the processing unit for each feed station each intrinsic weight so obtained. If the conversion is done by the data processing unit operator, or by other means such as a weighing scale calibrated in monetary values, the operator enters into the processing unit for each feed station the intrinsic monetary value so obtained.

In addition to entering these intrinsic values the data processing unit operator enters a value for each feed station indicative of, typically, a maximum number of documents which may be fed by the station for a particular mailpiece. For example, a high speed check feeder may feed up to 200 checks, a statement feeder up to four statement pages and an advertising insert station one insert per mailpiece.

After these steps of entering are completed the table generation program is enabled to generate the table. The resulting table may be in the form of a well known tree graph having the carrier envelope as the root node and each insert feeding station as a respective level of the tree. The height of the tree so generated can equal the total number of insert stations to be utilized during the impending run of the insertion machine plus the carrier envelope feeder. The number of nodes at a particular level can be a function of the maximum possible number of inserts which may be fed by that feeder times the total number of nodes comprising the next higher level. Each node, or entry within the table, contains a value indicative of at least a monetary value of postage.

After creation of the table, the table is transferred by a transfer medium, for example a floppy disk, from the stand-alone data processing unit to the memory of the inserter system. If the table is created by the inserter system processing unit, the table typically remains resident in the system processing unit memory.

Each node of the table as entered into the memory of the processing unit of the insertion machine contains data expressive of an amount of postage required for a given mailpiece. The nodes that are required to be traversed during a search of the table are determined by a key, such as a token provided on a master control document. Thus, during the run of the inserter system the processing unit quickly and accurately looks-up and determines the amount of postage required for a mailpiece in a straightforward manner by utilizing an efficient table search technique.

In accordance with the invention, the key is utilized to rapidly determine a required value of postage for a mailpiece in a non-calculating manner. That is, the postage value is determined by an efficient table search technique. In essence the key may be thought of as a map which allows the runtime table search program of the insertion machine to traverse the nodes of the tree data structure in order to arrive at a terminal, or leaf, node wherein the required mailpiece postage is stored.

The advantages of this table search technique of determining postage over systems of the prior art are speed of execution, resulting in higher machine throughput, and adaptability to dynamic changes in mailing requirements. That is, the number and/or type of inserts, including insert priority, may be rapidly altered up until runtime by the data processing unit operator entering the latest information into and executing the table generation program. A table may thereby be generated in a matter of minutes prior to an insertion run, the table reflecting the latest inserting information.

The table search technique also allows for modifying postage determining criteria from a criteria such as weight to a variety of different criteria such as, but not limited to, zone (destination), mailpiece size, etc.

The table search technique further also allows for the prioritization of inserts to be implemented in a straightforward manner. Such a prioritization scheme is especially valuable when it is desired to "top off" a mailpiece by the insertion of optional inserts which, when combined with the inserts already selected for insertion, will bring the total required postage amount of the mailpiece to just below or equal to a given postage threshold. Thus, the full value of a postage category may be realized.

In practice, if prioritization of inserts is not selected, the final postage amount as determined from the terminal node wll be rounded up to the next higher postage category and this amount of postage will be applied to the mailpiece. If prioritization is selected, the difference between the required postage amount, as indicated by the terminal node, and the next higher postage category is determined and the table searched in a recursive manner for those inserts of a suitable priority and of a suitable postage amount which may be included within the mailpiece without causing the final postage value amount to exceed the next higher category.

In an alternate embodiment of the invention, the individual entries of the table of data which are entered into the memory of the insertion machine are each expressive of not only a value of postage but, also, of which feeder stations to activate for a particular mailpiece. The information contained by the key, or token, for searching such a table may be expressive of predetermined characteristics associated with the addressee, such as demographic characteristics. Thus, the type and number of inserts for each addressee is optimized.

DETAILED DESCRIPTION OF THE INVENTION

Figure 1:
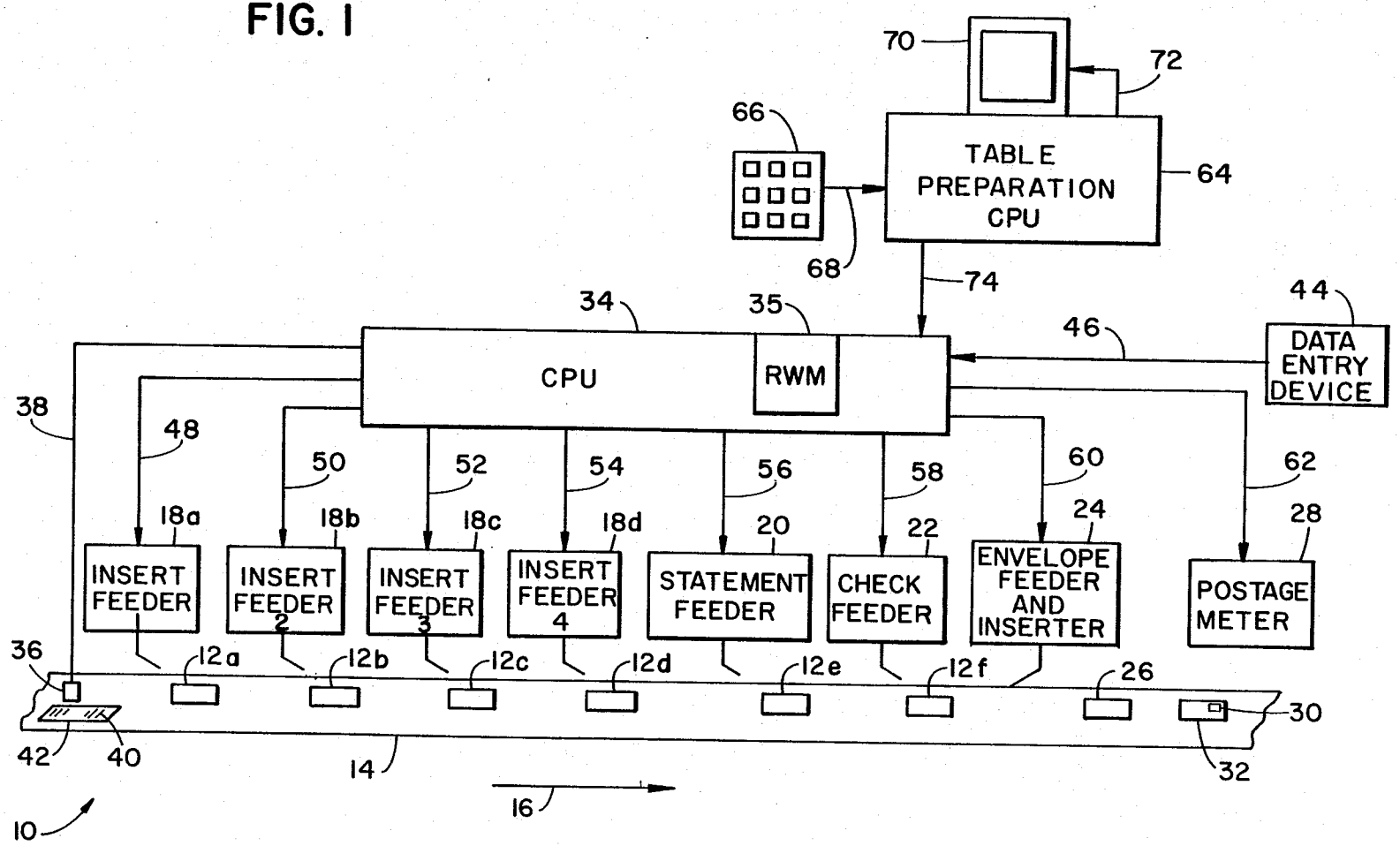
FIG. 1 is a block diagram of an electronic postal mailing system having one embodiment of the invention.

Referring now to FIG. 1 there is shown a multistation inserting system 10 having an embodiment of the invention. Although the system 10, as shown in FIG. 1, is adapted for use in a banking application, it should be realized that this is an illustrative embodiment only, and that the apparatus and method of the invention are well suited for use with a variety of different mailing systems including, but not limited to, billing systems, insurance systems and systems adapted for the mass mailing of advertising literature, and the like. The use of the invention is also applicable in parcel post mailing systems and also in order filling and mailing systems, wherein a mailpiece is comprised of items of diverse intrinsic postal cost.

In general, system 10 operates to feed documents from a plurality of document feeders onto a transport deck, the documents being collated as they are conveyed downstream on the deck to an envelope feeder and insertion station where the collated documents are inserted within an envelope. Thereafter the envelope is sealed and conveyed to a postage meter where a required amount of postage is applied. System 10, in this illustrative embodiment, is operable for reading a machine readable code, in the form of a data key or token, provided on a control document which is conveyed upon the deck, the key being indicative of, among other things, the priority of inserts held in a plurality of insert feed stations which are available to be included within a particular envelope. Controlling the operation of the document feeders is a system data processing unit. The processing unit is also operable for determining a required amount of postage for each stuffed envelope and for providing, by a suitable communications means, the postage information to the postage meter. The meter is comprised of a printing means, such as an ink jet printer, operable for printing a proof of postage, such as a postage indicia, indicative of the required postage amount upon each successive stuffed envelope. Such a postage indicia may take the form of a graphical pattern or a bar code or some other type of approved pattern for representing the monetary amount of the postage and other information, such as the postage meter serial number, the date, etc.

As may be seen more specifically in FIG. 1, a plurality of document collations 12*a* through 12*f* are disposed upon the surface of a transport deck 14 and are transported thereon in a direction indicated by the arrow 16.

Each of the collations 12*a* through 12*f* may be comprised of a different number of documents and document types, the document types being inserts, or enclosures, fed from a plurality of document entry devices, such as insert feeders 18. The collations will also generally be comprised of documents fed from multiple document entry devices such as a statement having one or more pages fed from statement feeder 20, and a plurality of bank checks fed from check feeder 22. As may be appreciated, collation 12*a* will generally be comprised of one or more inserts fed from feeder 18*a*, while collation 12*b* may be comprised of two or more inserts fed from feeder 18*a* and feeder 18*b*. Collation 12*c* may be comprised of three or more inserts, and so on.

Collation 12*f*, also referred to herein as a final collation, is comprised of a bank statement having one or more pages fed from feeder 20 and some variable number of checks fed from feeder 22. In addition, collation 12*f* may be comprised of one or more inserts fed from feeders 18*a* through 18*d*. Final collation 12*f* is transported to an envelope feeder and inserter 24, where it is inserted into an envelope. The operation of inserter 24 subsequently seals the stuffed envelope, or mailpiece, 26 which is thereafter conveyed to a postage printing device such as postage meter 28 to have a postage indicia 30 applied thereto. The postage metered envelope 32 will thereafter be transported to other, unillustrated portions of the system 10 where it may be sorted according to zip code and stacked for mailing.

Control of the operation of system 10 is provided by a control unit, which may be comprised of a computer, or central processing unit (CPU) 34. CPU 34, which may be a microcomputer, has a plurality of inputs and outputs (only some of which are shown in FIG. 1) for inputting document related data and for controlling the various document feeders, the inserter and the postage meter. Associated with CPU 34 is a read/write memory (RWM) 35 which is operable to have data written within and subsequently read by CPU 34. RWM 35 may be comprised of static or dynamic RAM semiconductors, magnetic disk, CCD serial type memory, or any suitable semiconductor or magnetic memory. The manner of interconnection of such memory and a CPU, such as CPU 34, via address, data and control signal lines, is well known in the art.

As may be seen in FIG. 1, there is coupled to CPU 34, in this embodiment of the invention, a document token reading device, such as an optical sensor 36 having an output 38. Sensor 36 is disposed relative to deck 14 such that it may sense a token, or data key, 40 provided on a control document 42, the key 40 being read by CPU 34 via output 38. Typically, one such control document 42 is provided for each customer mailpiece, the key 40 being indicative of, for example, the number of returned checks to be fed by feeder 22 and also which inserts contained in feeders 18*a* through 18*d* are to be included in the final collation 12*f*. As may be appreciated, in other embodiments of the invention such information may be provided to CPU 34 in a variety of different ways, such as by magnetic coding or by a direct communications link to a control document preparation source, such as an electronic data processing (EDP) computer (not shown).

The information may also be provided via a magnetic tape or disk obtained from the control document preparation source. A further significance of the key 40 in the use of invention will be described in detail hereinafter.

It should be realized that the key 40, in a banking application for example, may be provided upon each customer's statement, typically upon the first, or address bearing page of the statement. If this is the case, the statement feeder 20 would be positioned such that it would be the first feed station upon the transport deck 14, assuming the position shown as insert feeder 18*a* in FIG. 1. Sensor 36 would be disposed relative to feeder 20 such that it would sense the key 40 upon a statement page fed by feeder 20.

There may also be connected as an input to CPU 34 a data entry device 44, the device 44 being connected via a suitable cable 46. The data entry device 44, which may be an operator actuated keyboard or a separate EDP system, functions in general to enter system control data and the like into CPU 34.

In addition to the above described inputs, CPU 34 has a plurality of output lines 48 through 62 suitable for controlling the activation of the insert feeders 18, the statement feeder 20, the check feeder 22, the inserter 24 and the postage meter 28. For example, line 62 may be a serial data communications link operable for transmitting information expressive of a required value of postage to be applied by meter 28.

In accordance with the invention, system 10 may also be comprised of an autonomous, or stand-alone, table generation CPU 64. CPU 64 is provided, typically, with a data entry device such as a keyboard 66 connected via a suitable cable 68. CPU 64 will typically also be provided with a display device such as a CRT 70, also connected by a suitable cable 72. CPU 64 may be a personal computer, but a large variety of other computer types may likewise be used. For example, CPU 64 may be the same EDP computer which prepares the master control document 42.

As can be seen, CPU 64 is communicatively coupled to CPU 34 by a data output means 74, which means may be a serial communication link, a telephonic Modem, a parallel data bus, or a transferable magnetic storage device, such as a floppy disk or a tape cartridge. A purpose of data output means 74 is to transfer a predetermined table of postage related data generated by CPU 64 from CPU 64 to the RWM 35 of CPU 34. This aspect of the invention will be more fully described hereinafter.

It should be realized that an insertion system of the type described above is operable for simultaneously processing a plurality of individual mailpieces in a high speed and continuous manner.

The aforementioned table of postage related data is generated prior to a run of the inserter system 10 by a table generation program resident in the CPU 64. In operation, an operator would obtain the weight of each document type (including the required carrier envelope) which may be for a mailpiece during an impending run of the inserter system. The weight of each document type is referred to hereinafter as the "intrinsic" weight of that document type. Each intrinsic weight so obtained is converted to an intrinsic postage amount based upon Postal Service or other carrier provided criteria, the conversion being performed either by the operator or by the table generation program. For example, if the carrier envelope is found to weigh 0.100 ounces and if the first-class postage rate per ounce, based on the level of presort and zone (or destination), is $0.22, the envelope is assigned the intrinsic postage value of $0.022.

If the weight/postage value conversion is made by the table generation program, then the operator enters into the CPU 64 via the data entry means 66 each intrinsic document weight for each feed station. If the conversion is performed by the operator, or by a weighing scale if the scale if so calibrated, the operator enters into the CPU 64 the intrinsic monetary postage value so obtained for each feed station. Alternatively, the weighing scale may directly input into CPU 64 the intrinsic weight or monetary postage values.

In addition to entering the aforedescribed intrinsic values, the operator also enters a value for each feed station, indicative of, typically, a maximum number of documents which may be fed by the feed station for a particular mailpiece. For example, for each mailpiece a high speed check feeder may feed up to 200 checks, a statement feeder up to four statement pages, and an advertising insert station one insert. The operator may also enter a level of significance, or priority, for each of the documents which may be fed for a mailpiece. After these steps of entering are completed, the table generation program is enabled to generate the table by executing various software routines which are known to those skilled in the art.

Figure 2:
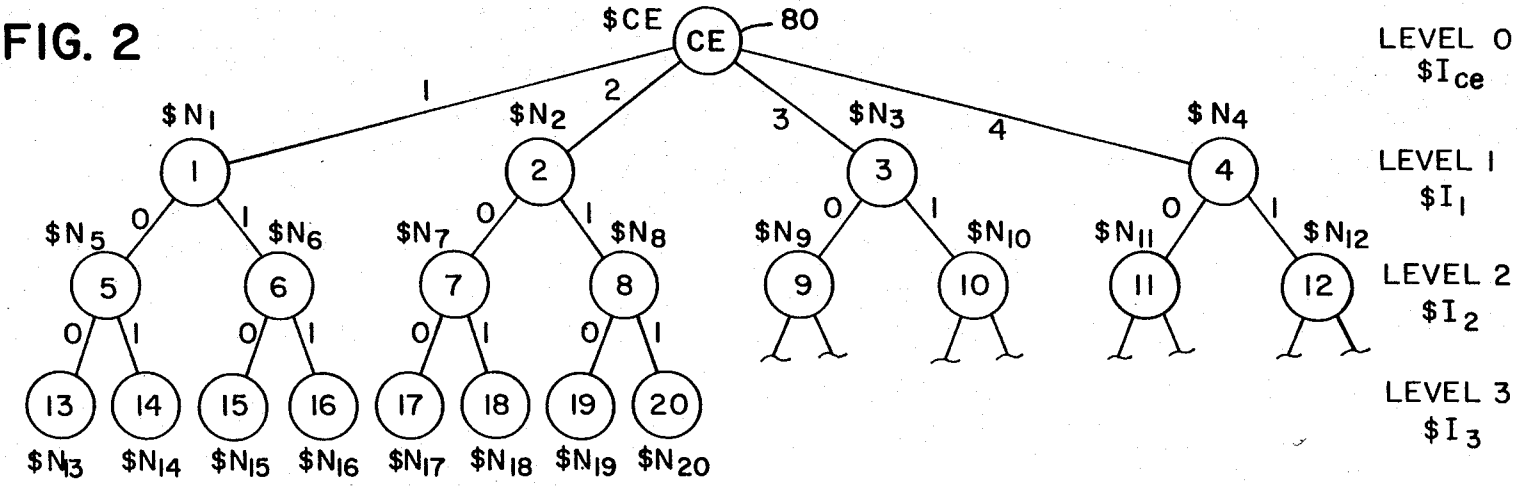
FIG. 2 is a depiction of a postal data structure generated in accordance with the invention.

Referring now to FIG. 2, there is shown an illustrative representation of one data table which may be generated by the CPU 64. The table as shown is in the form of a well known tree structure having the carrier envelope as the root node 80 and each insert feeding station as a respective level of the tree. The height of the tree so generated may equal the total number of insert stations to be utilized during the impending run plus the carrier envelope feeder. The total number of nodes at a particular level may be a function of the maximum possible number of inserts which may be fed by that feeder times the total number of nodes comprising the next higher level. Each node, or entry within the table, will contain a value $\$N_n$ (where n is the node number) indicative of a monetary value of postage.

It should be realized that this value $\$N_n$ is determined not only by the intrinsic weights of the enclosures comprising a collation corresponding to the node n but also by the postal weight/rate category to which this collation belongs. For example, if the carrier envelope is found to weigh 0.100 ounces, in accordance with the before mentioned example, and the total weight of the mailpiece including this envelope happened to be more than one ounce but less than two ounces the envelope is assigned the intrinsic postage value of 0.0195 cents (0.0195=39/200, based upon 39 cents of postage for first class mail having a weight between one ounce and two ounces). Thus, during the process of table generation each nodal value $\$N_n$ is compared to the values associated with postage breaks and are updated based upon the result of this comparison. In practice, this update can be achieved simply by multiplication of the nodal value by an appropriate coefficient. For instance, in accordance with this example where the total weight of the collation is between one ounce and two ounces, the appropriate coefficient is 0.886 (0.886=0.0195/0.022).

After creation of the table, the table is transferred via the data output means 74, for example floppy disk, from the CPU 64 to the RWM 35 of the inserter system 10. If the table is created by the CPU 34, the table will typically remain resident in the RWM 35.

As seen in FIG. 2, the tree structure created by the table generation program has the root node 80 (Level 0) which is the carrier envelope (CE) having an intrinsic monetary value $\$I_{CE}$. $\$I_{CE}$ may equal \$0.022 in accordance with the before mentioned example. Level 1 is representative of an insert feeder which may contain customer statements which may have, for example, from one to four pages, each additional page corresponding to a branch to a separate node 1 through 4. Each node 1 through 4 has associated with it a monetary value, $\$N_1$ through $\$N_4$, indicative of the node total monetary postage value. This total postage value is the sum of the monetary values of the nodes previously traversed to reach the node, which for Level 1 is only $\$I_{CE}$ plus the intrinsic value of the node itself. As is obvious, node 2 will have a greater value, $\$N_2$, than node 1 since node 2 will have a greater total intrinsic value indicative of two statement pages, each statement page having an intrinsic value of $\$I_1$. Similarly node 3 will have a greater total value, $\$N_3$, than node 2, etc. For example, the total value, $\$N_{16}$, of node 16 would be the sum of the intrinsic values of nodes CE, 1, 6 and 16. Put another way, $\$N_{16}$ is assigned to the value of $\$N_6$ plus the intrinsic monetary value of node 16, $\$I_3$. As may be appreciated, for those levels corresponding to feeders capable of feeding more than one document per machine cycle, such as the Level 1 of FIG. 2, the table generation program may determine the intrinsic values of the nodes at that level. This determination being based, typically, on the intrinsic values of one document, which value has been previously entered by the operator. For example, Node 1 has an intrinsic value of one document, $\$I_1$. Node 2, because it is representative of two documents, has an intrinsic monetary value of 2 times $\$I_1$, Node 3 the value of 3 times $\$I_1$, etc.

Figure 3:
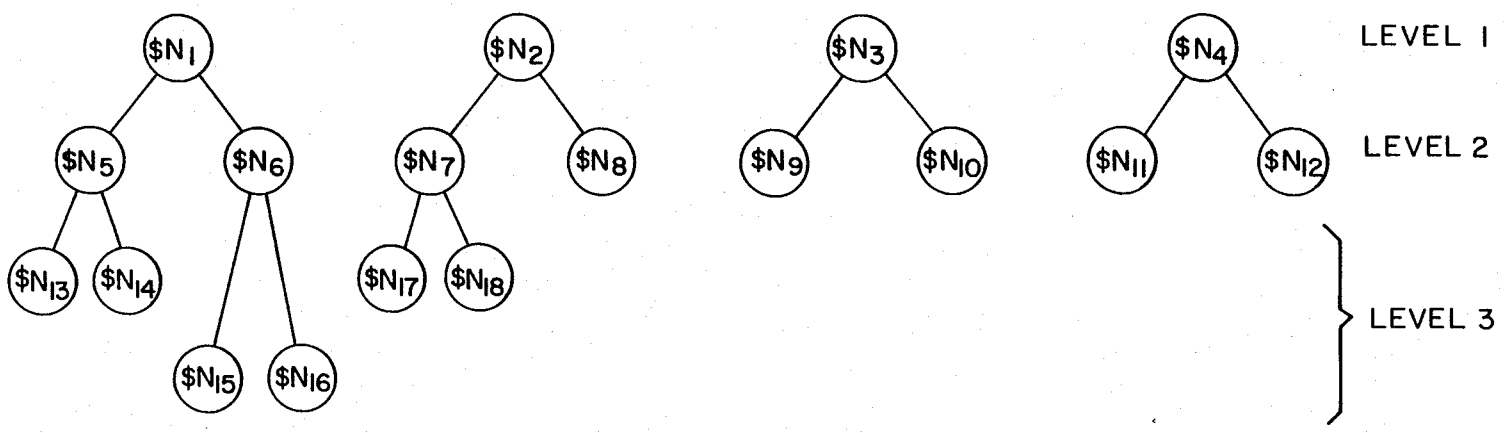
FIG. 3 is a depiction of the postal data structure of FIG. 2 shown in a modified form.

Referring now to FIG. 3, there is shown a second, reduced, table having a tree structure form created by the table generation program, which table may be loaded into the RWM 35 of the insertion system 10. The intrinsic value $\$I_{CE}$ of the node CE, (shown in FIG. 2) which may be considered a constant, has been incorporated into each of the nodes of level 1. Therefore no one node may be considered as indicating a value expressive of a weight of a document of a particular feed station. Instead, each node has a total value, $\$N_n$, associated with it, which is the sum of the intrinsic value of that node and the intrinsic value of at least one other node. The total value of each node is determined by the table generation program in accordance with the examples given above.

It can be realized that each node of the table, as entered into the RWM 35 of the CPU 34, contains data expressive of an amount of postage required for a given mailpiece which is comprised of documents represented by that node and the nodes which must be traversed to reach that node. The nodes that are required to be traversed for a given mailpiece are, typically, determined by the key 40 provided on the master control document 42. It can be further realized that during the run of the inserter system 10 that the CPU 34, by utilizing the key 40, may rapidly and accurately lookup and determine the amount of postage required for a mailpiece in a manner requiring no time consuming numerical calculations or costly, high-speed computer hardware.

For all the nodes of the tree that are binary in nature, such as levels 2 and 3, one node of a binary pair is indicative of a no-feed condition and the other node is indicative of a feed. Binary null branches leading to null nodes are utilized to indicate the nonactivation of a single insert per cycle type of feeder. The inclusion of the null nodes within the tree is advantageous when prioritized selection of inserts is provided during the run, as will be discussed hereinafter. Obviously, such a null node has an intrinsic monetary value of zero, therefore its monetary value $\$N_n$ will equal the monetary value of the connected node at the adjacent level nearer the root node. The node of a binary pair which indicates the activation of a single insert per cycle type of feeder has an intrinsic value equal to that of all other such nodes on that level, since each such node is representative of a single document or enclosure page.

An aspect of the present invention is the use of the key 40 as a data key to rapidly arrive at a required value of postage for a mailpiece in a time efficient manner. That is, the postage value is arrived at by an appropriate table search technique. In essence the key 40 may be considered to function as a map which allows the runtime table search program of the insertion system 10 to traverse the entries of the tree in order to locate a terminal node wherein the required mailpiece postage is stored.

Some advantages of this table search technique of determining postage are speed of execution, resulting in higher machine throughput, and adaptability to dynamic changes in mailing requirements. That is, the number and/or type of inserts, including insert priority, may be rapidly altered up until runtime by the operator entering the required changes into CPU 64 and executing the table generation program resident therein. A new, updated, table may thereby be generated in a relatively short period of time, the new table reflecting the altered inserting application.

The table search technique of the present invention also allows for the prioritization of inserts to be implemented in a straightforward manner. Such a prioritization scheme is especially valuable when it is desired to "top off" a mailpiece by the insertion of optional inserts which, when combined with the inserts already selected for insertion, will bring the total required postage amount of the mailpiece to just below or equal to a given postage threshold. Thus, the full value of a postage category may be realized.

In practice, if prioritization of inserts is not selected the final postage amount, as determined from a terminal, or leaf node, will be rounded up to the next highest postage category and this amount of postage applied to the mailpiece. In accordance with one aspect of the invention if prioritization based on the levels of significance is selected, the difference between the required postage amount, as indicated by the terminal node, and the next higher postage category is determined. The table may then be searched in a repetitive, or recursive, manner for those inserts of a suitable priority and of a suitable postage value which may be included within the mailpiece without causing the final postage value amount to exceed the next higher postage category. This search method, therefore, results in substantially all of the value of an amount of required postage due to a postage category being realized. In accordance with the invention, this recursive search procedure may be performed either in the EDP computer, which will thereby generate a key 40 indicative of both the required and the optional "topping off" enclosures, or the search procedure may be accomplished by the CPU 34 on a mailpiece by mailpiece manner during the operation of the system 10.

One use of the aforementioned null nodes during this prioritization search procedure is to allow the search program to reenter a higher level when a search downward into the next lower level finds an insert of an unsuitable priority level or an excessive intrinsic postage value. Another use is to provide a "bridge" between non-adjacent levels. It should be realized that the table search and the priority search programs during their operation may be building a list expressive of which insert feeders are required to be activated for a particular mailpiece. If such a null node is included within the list it simply indicates that the feeder associated with the level within which the null node is located is not to be activated for a particular mailpiece while subsequent, downstream, feeders may be.

Figures 4, 5:
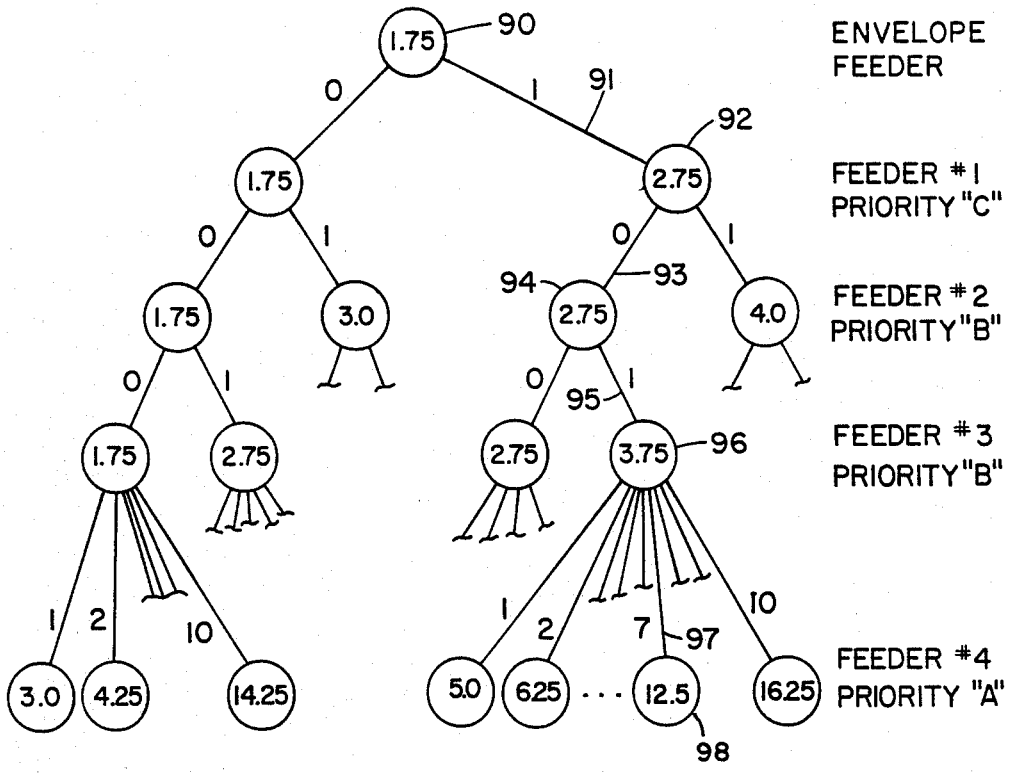
FIG. 4 is another depiction of a postal data structure of one embodiment of the invention.
FIG. 5 shows a postal data structure which is a feature of another embodiment of the invention.

Referring now to FIG. 4 there is shown, by way of example, a postage table generated in accordance with the invention. The postage table is generated for use with a four feeder station insertion system having an application requiring a presort level of ZP, which presort level corresponds to a ZIP+4 presort. It is assumed for this example that the applicable postal rate for such a presort level corresponds to 0.175 cents for each one hundredth of an ounce of weight. Based on this postal rate a mailpiece weighing one ounce would require 17.5 cents of postage, a mailpiece weighing two ounces would require 34.5 cents, etc., according to the current First Class mail rates.

The intrinsic weights and postage values (expressed in cents) of the various inserts are determined to be as follows:

| FEEDER | WEIGHT (ounce) | POSTAGE VALUE (cents) |
|---|---|---|
| ENVELOPE | 0.100 | 1.75 |
| FEEDER #1 | 0.057 | 1.00 |
| FEEDER #2 | 0.071 | 1.25 |
| FEEDER #3 | 0.057 | 1.00 |
| FEEDER #4 | 0.071 | 1.25 |

Furthermore, it is assumed that Feeders #1, #2 and #3 are each capable of feeding one insert per machine cycle while Feeder #4 is capable of feeding up to a maximum of ten inserts per machine cycle.

In accordance with the invention, the above intrinsic postage values and the maximum number of inserts fed by each feeding station are inputted into the table generation program resident in CPU 64. CPU 64 thereby generates a table of postage data, which table is partially diagrammed in FIG. 4.

The resulting table is comprised of a plurality of data entries shown as nodes and branches interconnecting the nodes. Within each node is stored the total value associated with the node, as has been previously described. The table is thereafter inputted into the RWM 35 of the system 10 via the data output means 74.

Furthermore, in accordance with the invention, each of the feeder stations may be assigned a level of significance, or priority, relative to a required value of postage associated with the enclosure type held within. For example, the existing postal rate system is based on twelve weight categories of 0.00 to 12.00 ounces. In inserting applications all weights over three ounces are typically considered as one category, therefore there are four weight categories of interest. The categories of interest are 0.00 to 0.99 ounces, 1.00 to 1.99 ounces, 2.00 to 2.99 ounces and 3.00 ounces or greater. For the purposes of this discussion 3.00 ounces will be assigned the weight threshold $t_3$, two ounces will be assigned the weight threshold $t_2$, and one ounce the weight threshold $t_1$, each such threshold being indicative of the point at which a different postage amount is required. It should be realized, however, that the various threshold values may be assigned based on a variety of different parameters, such as physical size, zone (destination), etc. Weight is but one of these parameters.

Based on the above described postal rate categorization, the levels of significance may be defined as follows:

(a) S=A when an enclosure must be inserted without reservation as to the total final weight of the mailpiece, (b) S=B when an enclosure should be inserted only if the total final weight of the mailpiece, including this enclosure, will not exceed $t_3$, (c) S=C when an enclosure should be inserted only if the total final weight of the mailpiece, including this enclosure, will not exceed $t_2$, and (d) S=D when an enclosure should be inserted only if the total final weight of the mailpiece, including this enclosure, will not exceed $t_1$.

It should be realized, however, that the number of levels of significance is not limited to four, in that a different postal rate categorization or other factors may result in more or less than four levels of significance being utilized for a particular application.

It should further be realized that the assignment of a particular level of significance to an enclosure may be based on a variety of application specific factors. One such factor may be a particular characteristic, such as a demographic characteristic, of each addressee. For example, in a banking application a particular enclosure may be assigned a significance level of D for certain of the bank's customers and a level of B or C for certain other of the bank's customers. The differentiation between customers may be made in a variety of manners, such as by other types of banking accounts maintained by the customers. In accordance with this example, an enclosure describing a new type of money market account to be offered by the bank may be considered to be of more significance to those of the bank's customers who already maintain money market accounts than to those of the bank's customers who only maintain a checking account. Therefore, such an enclosure may be assigned a relatively high significance level of A or B for some customers and a relatively low significance level of D for certain other of the bank's customers. It may be appreciated that in most insertion machines of the prior art all enclosures are by default assigned to level A, that is, all are included without reservation.

Inasmuch as the levels of significance are based, in this example, on maximum weight thresholds, the levels of significance are thereby also based on an amount of postage. An enclosure assigned to significance level C will be deemed to have a higher priority than an enclosure assigned to a level of D since the monetary amount of postage associated with weight threshold $t_2$ is greater than that associated with weight threshold $t_1$.

In accordance with the levels of significance described above, certain enclosures will by definition be considered level A enclosures. In a banking application the bank statement, cancelled customer checks, and the carrier envelope itself must all by necessity be included without reservation as to the final postage cost of the mailpiece. Additionally, one or more of the enclosures may convey important information applicable to all checking account customers. As an example, such an insert may give notification of a change in checking account fees. Such an insert may be considered to be of such general importance that it is assigned to a significance level of A, thereby causing this insert to be included with each mailpiece without regard for the total final weight and, hence, the postage cost of the mailpiece.

Other enclosures may be considered to be of more limited interest and, hence, are not required to be included in every mailpiece without reservation as to postage cost. These various insert types would therefore be assigned to the remaining significance levels, namely B, C or D.

Based on the foregoing, it can be seen that the enclosures contained in Feeder #1 are assigned the priority level of C, Feeders #1 and #3 the level of B, and the enclosures of Feeder #4 the level of A.

In order now to rapidly determine the correct amount of postage for a given mailpiece the table, which is now residing, or stored, within RWM 35, must be searched by an appropriate table search program in order to locate the terminal node which corresponds to the inserts which comprise the mailpiece. To facilitate the operation of the table search program the table search program is provided with the data key, which may be expressed within the key 40.

For example, a suitable key for use with the table depicted in FIG. 4 may be comprised of a 12 digit number for each feeder station. The first three digits identify the number of enclosures of Class A to be fed from the feeder (up to a maximum of 999), the second three digits the number of enclosures of Class B, etc. As may be appreciated, for an arbitrary number (n) of significance levels the number of digits required per feeder station is 3n.

If it is known that no more than 99 enclosures may be fed from any given feeder then two digits are required per significance level and the number of digits required per feeder is 2n. In general, if f represents the total number of feeders then the total number of digits required to express the complete key is 3nf digits if it is known that the maximum number of enclosures which may be fed per feeder is between 100 and 999, or 2nf digits if the maximum number of enclosures is 99 or less.

A key which may be provided for guiding the table search of FIG. 4 for a particular mailpiece requiring one Level C enclosure from Feeder #1, no Level B enclosures from Feeder #2, one Level B enclosure from Feeder #3 and seven level A enclosures from Feeder #4 is expressed as follows:

| | | | |
|---|---|---|---|
| 000 | 000 | 001 | 000 |
| 000 | 000 | 000 | 000 |
| 000 | 001 | 000 | 000 |
| 007 | 000 | 000 | 000. |

In accordance with this data key the table search program would traverse the nodes of FIG. 4 in the following manner.

Assuming that the program begins at the carrier envelope root node CE 90, the program would follow the branch 91 to the node 92, due to the key indicating that one Level C enclosure be fed from Feeder #1. The program would next follow the branch 93 to the null node 94, due to the key indication that no enclosures be fed from Feeder #2. From node 94 the program would follow the branch 95 to node 96, due to the key indicating that one level B enclosure be fed from Feeder #3. Finally, the program would follow the branch 97 to the terminal node 98, due to the seven level A enclosures required to be feed from Feeder #4. Within the node 98 is found the required value of postage of the mailpiece which, in this example, is seen to be 12.5 cents. This value of postage is less than the 34.5 cents allowed for an enclosure of Class C to be included, it being remembered that a Class C enclosure corresponds to threshold $t_2$, or two ounces, which inturn corresponds to a required postage value of 34.5 cents. If, however, the total postage, including the Class C enclosure from feeder #1, would exceed 34.5 cents, tthe program would traverse the postage tree structure in a reverse direction to eliminate the Class C enclosure from Feeder #1. Thus, the mailpiece would be comprised of only inserts having priority levels of Class A and B. If the required postage value, as determined from the terminal node 98, exceeded 51.5 cents (corresponding to threshold $t_3$) the program would, similarly, eliminate one or more of the Class B enclosures from feeders #2 or #3.

The actual method of implementation of the table search program of the invention may vary, depending on such factors as the number of storage locations available within RWM 35 or the required speed of program execution. For example, the search may be implemented by well known linked list addressing techniques, wherein each node, in addition to containing a value of postage, also contains data indicative of the addresses within RWM 35 of the other nodes which branch both upwards and downwards from the node. Such address data may be an absolute address of each of such other nodes or may be offset values which when combined with the address of the node will yield the addresses of the other connected nodes. Thus, it may be appreciated that the specific mode of implementation of the table generation and search technique of the present invention may be carried out in a number of suitable ways.

Referring now to FIG. 5 there is shown an alternate embodiment of the invention wherein the table is in the form of a regular array of table entries (not all entries being shown). Each level of the table corresponds to an addressee characteristic, such as characteristic A (CA), characteristic B (CB), etc.

For example, a three feeder station insertion system has, for each addressee, a variable number of statement documents fed from a feeder #3 and a prioritized selection of inserts fed from feeders #1 and #2. The prioritized selection may be based upon certain demographic or other characteristics of the addressee. These characteristics may be described as being within 26 classes, represented by letters of the alphabet. For example, assume that a certain addressee is determined to have the characteristics of a CA. All CA's are persons who make between 50 and 75 long distance calls per month, have two rented phones, are a private (non-business) account, etc. CB's may be the same except for 75 to 100 long distance calls per month. CC's may be the same except for 100 to 125 long distance calls per month, etc.

In addition to this classification, assume that the certain addressee has 5 statement pages in his bill. Thus, the look-up table address for this certain addressee is CA-5. In this address is stored the predetermined insert feeders to be actuated (Feeder #1 and Feeder #3 five times) and the required value of postage (17.25 cents) to be applied to the envelope.

Creation of the look-up table may be done by criteria established just prior to the insertion run, thereby including any last minute factors impacting the various priorities or properties of the inserts.

The advantages accrued by such off-line resolution of what criteria to consider in order to make an intelligent selection of enclosures and determination of postage include: the selection and determination can be done at a more leisurely pace (with slower, lower cost computers) since it is not being done in real-time (that is, during the run of the inserting system); the on-board inserter computer may be used instead for record keeping of the system's performance or for postage accounting functions and; a single stand-alone computer may serve several inserters rather than having one for each inserter, thereby reducing costs.

It should be realized that the above described embodiments of the invention may be modified in a variety of ways and those modifications would still be within the spirit and scope of the Applicants' invention. For example, one such modification may be controlling the system by some other means that by the control document, such as by directing inputting, via magnetic media, the key 40 from the CPU 64 or from the EDP computer. As another example, a variety of postage table generation techniques, table structures, and table search techniques may be employed. Thus, while this invention has been disclosed by means of specific, illustrative embodiments, the principles thereof are capable of a wide range of modification by those skilled in the art within the scope of the following claims.

What is claimed is:

1. A method of determining a required value of postage for a mailpiece comprised of at least one enclosure type, the method comprising the steps of:

generating a table of data having a plurality of entries each of which is expressive of one of a plurality of postage values which mailpieces may be assigned relative to the enclosure types which comprise the mailpieces;

identifying the enclosure types of a certain mailpiece for which the required value of postage is to be determined; and searching the table to locate an entry corresponding to the types of enclosure which comprise the certain mailpiece whereby the required value of postage for the mailpiece is determined.

2. The method of claim 1 further comprising the step of applying a postage indicia to the mailpiece, the postage indicia being expressive of the required value of postage determined during the step of searching.

3. The method of claim 1 wherein the step of generating comprises the steps of:

providing a first set of values each of which is indicative of a required value of postage for an individual one of each of the enclosure types;

providing a second set of values each of which is indicative of a number of individual ones of enclosure types which may comprise the mailpiece; and generating the table of data from the first and the second set of values so provided whereby the plurality of table entries are expressive of values of postage which mailpieces may be assigned relative to the required value of postage for individual ones of each of the enclosure types and the number of individual ones of the enclosure types.

4. A system for determining a required value of postage for a specific mailpiece, the mailpiece being comprised of at least one enclosure type, the system comprising:

means for generating a table of data, said table having a plurality of entries each of which is expressive of one of a plurality of required values of postage which mailpieces may be assigned relative to the enclosure types which comprise the mailpieces;

means for identifying the enclosure types of the specific mailpiece for which the required value of postage is to be determined; and means for searching said table to locate a specific one of said entries, said specific one corresponding to the enclosure types which comprise the mailpiece whereby the required value of postage for the specific mailpiece is determined.

5. The system of claim 4 further comprising means for applying to the mailpiece an indicia expressive of the required value of postage, said means for applying being coupled to said means for searching for applying said determining required value of postage to the mailpiece.

6. The system of claim 4 further comprising means for reading a data key, said means for reading being coupled to said means for identifying for inputting said read data key thereto, said data key being provided for the specific mailpiece for specifying which of said enclosure types will comprise the specific mailpiece, said key further specifying a number of how many of individual ones of each of said enclosure types comprise the mailpiece, said data key being operable for guiding said means for searching for searching said table.

7. The system of claim 4 wherein said means for generating is a first data processing means for executing a table generation program and for outputting said generated table.

8. The system of claim 7 wherein said means for identifying and said means for searching are a second data processing means for inputting said generated table from said first processing means and for executing a table search program whereby said specific entry is located and whereby said required value of postage is determined.

9. A mailing system comprising an insertion machine for the insertion of at least one enclosure type into an envelope to form a mailpiece therefrom, the machine comprising a plurality of enclosure feed stations disposed along a conveying means, the feed stations being operable for feeding at least one enclosure type held within onto the conveying means whereby the enclosures are conveyed past individual ones of the feed stations to an envelope inserting station wherein a set of the conveyed enclosure types are inserted within an envelope to form the mailpiece, the machine further comprising a postage applying means for applying a required value of postage to the mailpiece, the system further comprising:

means for reading a data key, said data key specifying at least one feeding station which is to feed an enclosure type for the mailpiece, said data key further specifying a number of individual ones of said enclosure types to be fed from each of said selected feeding stations;

means for activating said selected feeding stations to feed, said means for activating being responsively coupled to said means for reading; and means for determining the required value of postage for a specific mailpiece, said means for determining being coupled to said postage applying means for causing said postage applying means to apply the determined value of postage to the specific mailpiece, said means for determining comprising:

means for generating a table of postage data, said table being comprised of a plurality of entries each one of which is expressive of a required value of postage for a mailpiece relative to enclosure types and a number of individual ones of the enclosure types which may comprise the specific mailpiece; and means for searching said generated table, said means for searching being coupled to said means for reading in order to locate an entry corresponding to the enclosure types and the number of individual ones of each of the enclosure types specified by said data key whereby the required value of postage for the specific mailpiece is determined.

10. The system of claim 9 wherein said means for reading, said means for activating, said means for determining, said means for generating and said means for searching are a data processing means coupled to said insertion machine.

11. The system of claim 9 wherein said means for reading, said means for activating, said means for determining and said means for searching are a first data processing means coupled to said insertion machine, and wherein said means for generating is a second data processing means coupled to said first data processing means.

12. The system of claim 11 wherein said second data processing means comprises a data output means for outputting said generated table of postage data and wherein said first data processing means comprises a data input means for inputting from said second data processing means said generated table of postage data, said first data processing means further comprising a memory for storing said inputted table.

13. A method of determining a required value of postage for a mailpiece comprised of a carrier envelope and at least one enclosure selected from at least one type of enclosure, comprising the steps of:

(a) entering into a data processing means a value representative of an intrinsic value of postage associated with the carrier envelope;

(b) entering into the data processing means a value representative of an intrinsic value of postage associated with an individual one of the enclosures of each of the enclosure types;

(c) entering into the data processing means a value representative of a predetermined number of individual ones of enclosures of each of the enclosure types which may comprise the mailpiece;

(d) generating a table of postage values with the data processing means, the data processing means utilizing the values entered in steps (a), (b) and (c) to generate the table, the table being comprised of a plurality of entries each of which is expressive of a possible required value of postage which the mailpiece may be assigned;

(e) providing a data key conveying information expressive at least for specifying the type and number of each type of enclosure required for the mailpiece; and (f) searching the table to locate a specific one of the entries which corresponds to the information specified by the data key to determine from the specific one of the entries so located the required value of postage for the mailpiece.

14. The method of claim 13 further comprising the step of entering into the data processing means a value representative of a priority of each of the enclosure types relative to a postage threshold.

15. The method of claim 13 wherein the information conveyed by the data key is further expressive for indicating a relative significance of each of the types of enclosures one to another.

16. The method of claim 13 further comprising the step of applying an amount of postage to the mailpiece, the amount of postage so applied being determined by the step of searching.

17. A method of determining which ones of a plurality of enclosure types held in respective ones of a plurality of feeder stations are to be fed for inclusion within a mailpiece addressed to a specific addressee, the method further determining an amount of postage required for the mailpiece relative to the enclosures included within, comprising the steps of:

(a) generating a table of data, the table having a plurality of entries each of which is expressive of predetermined feeder stations required to feed enclosures for a particular mailpiece, each of the entries further indicating a value of postage required for the particular mailpiece relative to the enclosures fed therefore;

(b) determining a data key indicative of certain characteristics of an addressee, the data key further being indicative of a specific one of the plurality of entries;

(c) utilizing the data key to locate the specific one of the entries within the table;

(d) determining from the specific one of the entries so located which ones of the feeder stations to activate for feeding the enclosure type held within for inclusion within the mailpiece; and (e) determining further from the specific one of the entries so located a value of postage required for the mailpiece.

18. The method of claim 17 further comprising the steps of:

(f) feeding the enclosure types as determined in step (d);

(g) including the enclosures so fed within a mailpiece; and (h) applying a value of postage to the mailpiece, the value of the postage so applied being determined in step (e).

19. The method of claim 17 wherein the certain characteristics of the addressee are demographically determined characteristics.

20. The method of claim 17 wherein the step of generating further comprises the steps of:

determining a value indicative of an intrinsic value of postage associated with an individual one of each of the enclosure types;

determining a number of individual ones of enclosures of each of the enclosure types to be fed for the particular mailpiece;

inputting each determined intrinsic value and each determined number into a data processing means; and executing a table generation program within the data processing means, the program utilizing the inputted intrinsic values and numbers to determine the required value of postage for the particular mailpiece.

21. A method of determining which ones of a plurality of enclosure types held in respective ones of a plurality of feeder stations are to be fed for inclusion within a mailpiece addressed to a specific addressee, each of the enclosure types having assigned thereto a level of priority relative to others of the enclosure types, the method further determining an amount of postage required for the mailpiece relative to the enclosures included within, comprising the steps of:

(a) generating a table of data, the table having a plurality of entries each of which is expressive of a value of postage required for the particular mailpiece relative to the enclosures fed therefore;

(b) determining a data key indicative of certain characteristics of an addressee, the data key further being indicative of predetermined feeder stations selected to feed enclosures for a particular mailpiece, the predetermined feeder stations being selected in accordance with the certain characteristics and the priority level assigned to the enclosure types;

(c) searching the table of data to locate a specific one of the entries corresponding to the predetermined feeder stations indicated by the data key; and (d) determining from the specific one of the entries so located the amount of postage required for the particular mailpiece.

22. The method of claim 21 further comprising the steps of:

(e) feeding the enclosure types as indicated in step (b);

(f) including the enclosures so fed within a mailpiece; and (g) applying a value of postage to the mailpiece, the value of the postage so applied being determined in step (d).

23. The method of claim 21 wherein the certain characteristics of the addressee are demographically determined characteristics.

24. The method of claim 21 wherein the step of generating further comprises the steps of:

determining a value indicative of an intrinsic value of postage associated with an individual one of each of the enclosure types;

determining a number of individual ones of enclosures of each of the enclosure types to be fed for the particular mailpiece;

inputting each determined intrinsic value and each determined number into a data processing means; and executing a table generation program within the data processing means, the program utilizing the inputted intrinsic values and determined numbers to determine the required value of postage for the particular mailpiece.

25. A method of selectively determining relative to a value of postage which ones of a plurality of different enclosure types are to be provided by a mailing system for inclusion within a mailpiece in order that substantially all of the value of a postage category is realized, the system comprising a processing unit operable at least for having enclosure related data entered therein and also for selectively activating individual ones of a plurality of enclosure feeding stations for feeding individual ones of an enclosure type contained therein, the method comprising the steps of:

(a) generating a table of data, the table having a plurality of entries each of which is expressive of a value of postage required for the mailpiece relative to the enclosure types included within, each of the entries further being expressive of a level of significance relative to a value of postage associated with an associated enclosure type;

(b) identifying at least one enclosure type having a significance which require it to be included within the mailpiece;

(c) searching the table to locate a first entry corresponding to the required enclosure types to determine a first required value of postage for the mailpiece;

(d) determining a difference, if any, between the first required value of postage and a value associated with a next consecutively higher postage category; and (e) searching the table, if required, until a second entry is located, the second entry being indicative of the required enclosure types and at least one optional enclosure type, the second entry further being indicative of a second required value of postage which more closely approaches the value associated with the next consecutively higher postage category without exceeding the value of the category, whereby a final required postage value for the mailpiece is determined such that substantially all of the required value of a postage category is realized.

26. The method of claim 25 wherein the steps (d) and (e) are performed by the processing unit of the mailing system.

27. The method of claim 25 wherein the steps (d) and (e) are performed by a processing unit external to the mailing system.

* * * * *